US007548704B2

(12) United States Patent
Hasegawa et al.

(10) Patent No.: US 7,548,704 B2
(45) Date of Patent: Jun. 16, 2009

(54) IMAGE FORMING APPARATUS EFFECTIVELY CONDUCTING A PROCESS CONTROL

(75) Inventors: Shin Hasegawa, Zama (JP); Shinji Kato, Kawasaki (JP); Hitoshi Ishibashi, Kamakura (JP); Kohta Fujimori, Yokohama (JP); Naoto Watanabe, Atsugi (JP); Osamu Ariizumi, Yokohama (JP); Nobutaka Takeuchi, Yokohama (JP); Kayoko Tanaka, Tokyo (JP); Yushi Hirayama, Sagamihara (JP); Shinji Kobayashi, Atsugi (JP); Takashi Enami, Chigasaki (JP); Kazumi Kobayashi, Yokohama (JP); Fukutoshi Uchida, Kawasaki (JP); Ryohta Morimoto, Ebina (JP)

(73) Assignee: Ricoh Co., Ltd., Tokyo (JP)

( * ) Notice: Subject to any disclaimer, the term of this patent is extended or adjusted under 35 U.S.C. 154(b) by 174 days.

(21) Appl. No.: 11/689,599

(22) Filed: Mar. 22, 2007

(65) Prior Publication Data

US 2007/0230979 A1 Oct. 4, 2007

(30) Foreign Application Priority Data

Mar. 22, 2006 (JP) ..... 2006-079542

(51) Int. Cl.
*G03G 15/00* (2006.01)

(52) U.S. Cl. ..... 399/49; 399/302

(58) Field of Classification Search ..... 399/49, 399/66, 302, 308; 347/115, 116
See application file for complete search history.

(56) References Cited

U.S. PATENT DOCUMENTS

| | | | | |
|---|---|---|---|---|
| 6,496,677 | B2 | 12/2002 | Fujimori | |
| 7,139,511 | B2 | 11/2006 | Ishibashi | |
| 2001/0004425 | A1 * | 6/2001 | Shinohara et al. | 399/49 X |
| 2002/0044787 | A1 * | 4/2002 | Katayanagi et al. | 399/49 |
| 2003/0142988 | A1 * | 7/2003 | Kimura | 399/49 |
| 2005/0105926 | A1 * | 5/2005 | Akatsu et al. | 399/49 |

(Continued)

FOREIGN PATENT DOCUMENTS

JP 07-253729 10/1995

(Continued)

OTHER PUBLICATIONS

U.S. Appl. No. 12/112,525, filed Apr. 30, 2008, Koizumi et al.

*Primary Examiner*—Sophia S Chen
(74) *Attorney, Agent, or Firm*—Oblon, Spivak, McClelland, Maier & Neustadt, P.C.

(57) ABSTRACT

An image forming apparatus includes at least one image bearing member, an intermediate transfer member, a secondary transfer member, and at least one optical sensor. In the image forming apparatus, it is determined that output values of the respective amounts of toner detected by the at least one optical sensor are affected by an impact caused due to a separation of the secondary transfer member from the intermediate transfer member and the output values are ignored as image adjustment input information, when the secondary transfer member separates from the intermediate transfer member during any of writing, developing, and transferring the plurality of image adjustment patterns, if the output values fall outside a given range and an interval between the output values of adjacent image bearing members is substantially equal to a distance between the two adjacent image bearing members for the primary transfer.

12 Claims, 5 Drawing Sheets

U.S. PATENT DOCUMENTS

| | | | | |
|---|---|---|---|---|
| 2006/0002724 | A1 | 1/2006 | Fujimori et al. | |
| 2006/0024076 | A1 * | 2/2006 | Kato et al. | 399/49 |
| 2007/0230978 | A1 * | 10/2007 | Zaima | 399/49 |
| 2008/0124107 | A1 | 5/2008 | Takeuchi et al. | |

FOREIGN PATENT DOCUMENTS

| | | | |
|---|---|---|---|
| JP | 08-111992 | | 4/1996 |
| JP | 09-204108 | | 8/1997 |
| JP | 2004-287337 | | 10/2004 |
| JP | 2006-047681 | A * | 2/2006 |
| JP | 2006-251406 | | 9/2006 |

* cited by examiner

IMAGE FORMING APPARATUS EFFECTIVELY CONDUCTING A PROCESS CONTROL

CROSS REFERENCE TO RELATED APPLICATIONS

The present application claims priority to Japanese patent application no. 2006-079542, filed in the Japan Patent Office on Mar. 22, 2006, the disclosure of which is incorporated by reference herein in its entirety.

BACKGROUND OF THE INVENTION

1. Field of the Invention

The present invention relates to an image forming apparatus, and more particularly relates to an image forming apparatus that can effectively conduct image forming process control by controlling a timing for forming an image adjustment pattern and a timing for separating a secondary transfer member from an intermediate transfer member.

2. Discussion of the Related Art

In related art image forming apparatuses with a tandem type configuration, a plurality of image forming devices are provided thereto.

Each of the plurality of image forming devices includes an image bearing member and other image forming components arranged around the image bearing, together with at least one image transfer member, for conducting a series of image forming operations.

Specifically, an image bearing member of each of the plurality of image forming devices is uniformly charged by a charging unit, which is one of the image forming components, and irradiated by a writing unit so as to form an electrostatic latent image on a surface thereof.

The electrostatic latent image formed on the image bearing member is developed by a developing unit, which is also one of the image forming components, into a visible toner image.

The visible toner image on each of the plurality of image forming devices is primarily transferred onto an intermediate transfer member into a full color toner image in an overlaying manner.

The overlaid toner image is electrically attracted by a secondary transfer member at a secondary transfer portion and transferred onto a recording medium, such as a transfer sheet.

The overlaid toner image on the recording medium is fixed by a fixing unit and discharged to a sheet discharging tray.

The above-described operations may be conducted by a related art image forming apparatus with one image bearing member provided thereto.

In this case, the image bearing member receives and develops the toner images one by one for four times according to the number of colors of toner so as to primarily transfer the toner images onto the intermediate transfer member to form an overlaid full color toner image on the intermediate transfer member.

In addition to the image forming operations, the related art image forming apparatus conducts a series of image adjustment operations for adjusting image density, tone, etc.

For conducting the image adjustment operations, the related art image forming apparatus may further include optical sensors.

A plurality of toner patterns for image adjustment (hereinafter, referred to as "image adjustment pattern") are formed in a non-image forming area on each surface of the plurality of image bearing members.

After the plurality of image adjustment patterns have been transferred onto the intermediate transfer member, the optical sensors provided for each color of toner detect the plurality of image adjustment patterns so that image forming parameters can be optimally adjusted.

In one technique for related art image forming apparatuses provided with optical sensors, the optical sensors are disposed so as to face the intermediate transfer member and arranged at a downstream side of a primary transfer portion in a travel direction of the intermediate transfer member and at an upstream side of a secondary transfer portion in a travel direction of the intermediate transfer member.

However, when the optical sensors are disposed in a face-up manner with respect to the surface of the intermediate transfer member, toner may be scattered from toner images. This can cause incorrect sensing and incorrect detection results.

Further, some distance for arranging the optical sensors may be required between the primary transfer portion and the secondary transfer portion.

These conditions cannot cause a reduction of space and a reduction of time for first print output.

In a different technique for related art image forming apparatuses, optical sensors are disposed at a downstream side of the secondary transfer portion in a travel direction of the intermediate transfer member.

In this case, the secondary transfer member is applied with a bias having a same polarity as toner when a plurality of image adjustment patterns formed on the intermediate transfer member pass by the secondary transfer portion, so that the plurality of image adjustment patterns cannot be transferred to the secondary transfer roller.

Some amount of toner, however, may transfer onto the secondary transfer roller. In addition, the amount of transferred toner may depend on environmental conditions.

For example, when the surface of the secondary transfer roller is contaminated, the backside of a transfer sheet may also be contaminated and/or the plurality of image adjustment pattern may be deformed or skewed enough to obtain an incorrect detection result.

To eliminate the above-described drawbacks, the secondary transfer member can separate from the intermediate transfer member when the plurality of image adjustment patterns pass by the secondary transfer portion.

However, when the plurality of image adjustment patterns are formed while printing a series of images, the intermediate transfer member can cause nonuniformity or unevenness in rotations thereof, and can result in an adverse affect on image quality.

To avoid deformation in the plurality of image adjustment patterns, a secondary transfer member may include a non-contact type transfer member such as corotron. It is, however, easily assumed that a secondary transfer member employing a corotron method can cause an increase of an amount of ozone production. In addition, a different operation may be required for conveying a transfer sheet. These possibilities can increase ineffectiveness in both image forming and adjustment operations.

As described above, in such related art image forming apparatus including a plurality of image forming devices and an intermediate transfer member, image forming process and toner density are controlled by changing image forming conditions and forming a plurality of image adjustment patterns having different amounts of toner.

In this case, it is difficult to conduct a regular image forming operation and an image adjustment operation at the same time. Therefore, the regular image forming operation such as a production of copies and prints may need to be stopped while the image adjustment operation is being conducted.

The time period of stopping the regular image forming operation for the image adjustment operation may be regarded as a downtime for users. Therefore, the downtime may need to be reduced as much as possible.

SUMMARY OF THE INVENTION

Exemplary aspects of the present invention have been made in view of the above-described circumstances.

Exemplary aspects of the present invention provide an image forming apparatus that can effectively conduct an image forming process control by ignoring an output value obtained during a separation of a secondary transfer member from an intermediate transfer member when the output value satisfies two predetermined conditions while any of writing, developing, and transferring a plurality of image adjustment patterns is conducted.

Other exemplary aspects of the present invention provide an image forming apparatus that can provide a detection unit to detect that an output value satisfies a predetermined condition so as to determine whether the input value is ignored or not as input information.

Other exemplary aspects of the present invention provide an image forming apparatus that can provide a determination unit to determine whether to conduct a formation of a plurality of image adjustment patterns.

In one exemplary embodiment, an image forming apparatus includes at least one image bearing member configured to bear an image in an image forming area thereof for an image forming operation and a plurality of image adjustment patterns in a non-image forming area thereof for an image adjustment operation, an intermediate transfer member disposed so as to be held in contact with the at least one image bearing member for a primary transfer and configured to receive a plurality of image adjustment patterns formed on the at least one image bearing member, a secondary transfer member disposed so as to be held in contact with the intermediate transfer member for a secondary transfer and configured to transfer the image onto a recording medium during the image forming operation, and separating from the intermediate transfer member when the plurality of image adjustment patterns are transferred onto the intermediate transfer member during the image adjustment operation, and at least one optical sensor disposed at a downstream side of the transfer portion in a travel direction of the intermediate transfer member, and configured to detect respective amounts of toner adhered to the plurality of image adjustment patterns so that the image forming apparatus conducts an image forming process control by controlling each toner density of the plurality of image adjustment patterns based on the detected amounts of toner. In the above-described image forming apparatus, it is determined that output values of the respective amounts of toner detected by the at least one optical sensor are affected by an impact caused due to a separation of the secondary transfer member from the intermediate transfer member and the output values of the respective amounts of toner are ignored as image adjustment input information, when the secondary transfer member separates from the intermediate transfer member during any of writing the plurality of image adjustment patterns on the at least one image bearing member in a circumferential direction of the intermediate transfer member, developing the plurality of image adjustment patterns, and transferring the plurality of image adjustment patterns onto the intermediate transfer member, if the output values of the respective amounts of toner fall outside a given range and an interval between the output values of adjacent image bearing members of the at least one image bearing member is substantially equal to a distance between the two adjacent image bearing members for the primary transfer.

Further, in one exemplary embodiment, an image forming apparatus includes at least one image bearing member configured to bear an image in an image forming area thereof for an image forming operation and a plurality of image adjustment patterns in a non-image forming area thereof for an image adjustment operation, an intermediate transfer member disposed so as to be held in contact with the at least one image bearing member for a primary transfer and configured to receive a plurality of image adjustment patterns formed on the at least one image bearing member, a secondary transfer member disposed so as to be held in contact with the intermediate transfer member for a secondary transfer and configured to transfer the image onto a recording medium during the image forming operation, and separating from the intermediate transfer member when the plurality of image adjustment patterns are transferred onto the intermediate transfer member during the image adjustment operation, and at least one optical sensor disposed at a downstream side of the transfer portion in a travel direction of the intermediate transfer member, and configured to detect respective amounts of toner adhered to the plurality of image adjustment patterns so that the image forming apparatus conducts an image forming process control by controlling each toner density of the plurality of image adjustment patterns based on the detected amounts of toner. The above-described image forming apparatus further includes a determination unit configured to determine whether an impact is caused due to a separation of the secondary transfer member from the intermediate transfer member. The above-described image forming apparatus is controlled to refrain from forming the plurality of image adjustment patterns created based on the output values obtained by the at least one optical sensor when the secondary transfer member separates from the intermediate transfer member if the determination unit determines that a frequency of the impact is outside of a given range.

Further, in one exemplary embodiment, an image forming apparatus includes at least one image bearing member configured to bear an image in an image forming area thereof for an image forming operation and a plurality of image adjustment patterns in a non-image forming area thereof for an image adjustment operation, an intermediate transfer member disposed so as to be held in contact with the at least one image bearing member for a primary transfer and configured to receive a plurality of image adjustment patterns formed on the at least one image bearing member, a secondary transfer member disposed so as to be held in contact with the intermediate transfer member for a secondary transfer and configured to transfer the image onto a recording medium during the image forming operation, and separating from the intermediate transfer member when the plurality of image adjustment patterns are transferred onto the intermediate transfer member during the image adjustment operation, and at least one optical sensor disposed at a downstream side of the transfer portion in a travel direction of the intermediate transfer member, and configured to detect respective amounts of toner adhered to the plurality of image adjustment patterns so that the image forming apparatus conducts an image forming process control by controlling each toner density of the plurality of image adjustment patterns based on the detected amounts of toner. The image forming apparatus further includes a detection unit configured to detect a change in a rotational transfer velocity of the intermediate transfer member. In the above-described image forming apparatus, the output values obtained by the at least one optical sensor are ignored as image adjustment input information for image condition adjustment if the detection unit detects that the rotational transfer velocity of the intermediate transfer member falls outside of a given range.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
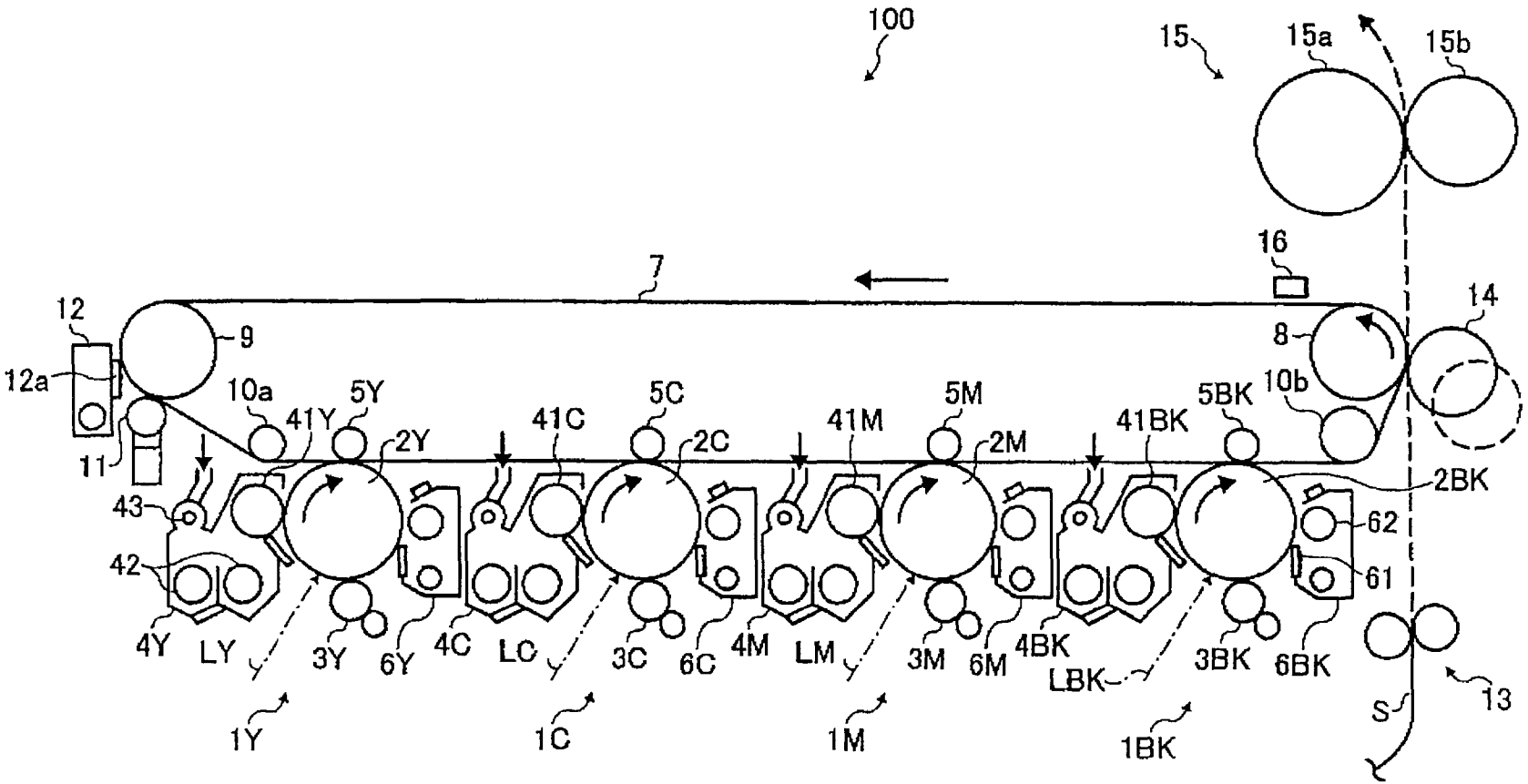
FIG. 1 is a cross sectional view showing a schematic configuration of an image forming portion of an image forming apparatus according to at least one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic configuration of an image forming apparatus 100 according to an exemplary embodiment of the present invention is described.

The image forming apparatus 100 of FIG. 1 includes a plurality of image forming devices 1Y, 1C, 1M, and 1BK, primary transfer member 5Y, 5C, 5M, and 5BK, an intermediate transfer belt 7, a secondary transfer roller 14, a fixing device 15, and an optical writing device (not shown).

As the image forming apparatus 100 employs an image forming method with a tandem type configuration, the plurality of image forming devices 1Y, 1C, 1M, and 1BK may include a plurality of photoconductors 2Y, 2C, 2M, and 2BK, respectively. Each of the photoconductors 2Y, 2C, 2M, and 2BK serve as image bearing member to form a monochrome or black-and-white image to a full-color image on a surface thereof.

The image forming devices 1Y, 1C, 1M, and 1BK are similar in structure and functions, except for toner colors.

The suffixes of these reference numbers correspond to respective colors of toner. For example, "Y" corresponds to yellow color toner, "C" corresponds to cyan color toner, "M" corresponds to magenta color toner, and "BK" corresponds to black color toner.

In an exemplary embodiment of the present invention, the image forming devices 1Y, 1C, 1M, and 1BK may further respectively include photoconductors 2Y, 2C, 2M, and 2BK, charging rollers 3Y, 3C, 3M, and 3BK, developing units 4Y, 4C, 4M, and 4BK, and cleaning units 6Y, 6C, 6M, and 6BK.

The charging rollers 3Y, 3C, 3M, and 3BK, the developing units 4Y, 4C, 4M, and 4BK, and the cleaning units 6Y, 6C, 6M, and 6BK are respectively arranged around the respective photoconductors 2Y, 2C, 2M, and 2BK according to the order of steps for a series of image forming operations.

Specifically, the image forming device 1Y includes the photoconductor 2Y with the charging roller 3Y, the developing unit 4Y, and the cleaning unit 6Y arranged around the photoconductor 2Y according to the order of steps for the series of image forming operations.

Similarly, the image forming device 1C includes the photoconductor 2C with the charging roller 3C, the developing unit 4C, and the cleaning unit 6C arranged around the photoconductor 2C according to the order of steps for the series of image forming operations. The image forming device 1M includes the photoconductor 2M with the charging roller 3M, the developing unit 4M, and the cleaning unit 6M arranged around the photoconductor 2M according to the order of steps for the image forming operations. The image forming device 1BK includes the photoconductor 2BK with the charging roller 3BK, the developing unit 4BK, and the cleaning unit 6BK arranged around the photoconductor 2BK according to the order of steps for the image forming operations.

The image forming devices 1Y, 1C, 1M, and 1BK may be held in contact with the intermediate transfer belt 7 that serves as an intermediate transfer member, on an extended flat area of the surface thereof.

Details of the intermediate transfer belt 7 will be described later.

Each of the photoconductors 2Y, 2C, 2M, and 2BK includes an electrically conductive supporting member having a cylindrical shape, and rotates in a direction indicated by respective arrows in FIG. 1.

Each of the photoconductors 2Y, 2C, 2M, and 2BK may have a base layer on the surface of the electrically conductive supporting member.

On the base layer, a charge generation layer (lower layer) and a charge transport layer (upper layer), both of which serve as photoconductive layers, may be laminated.

The order of the lamination of these layers can be reversed. Specifically, the charge transport layer can be a lower layer and the charge generation layer can be an upper layer.

Further, the photoconductors 2Y, 2C, 2M, and 2BK may include a heretofore known surface protection layer on the surface of the charge transport layer or the charge generation layer. The surface protection layer may be an overcoating layer mainly including thermoplastic polymer or thermosetting polymer, for example.

In an exemplary embodiment of the present invention, the electrically conductive supporting member having a cylindrical shape of the photoconductors 2Y, 2C, 2M, and 2BK are grounded.

The charging rollers 3Y, 3C, 3M, and 3BK uniformly charge the surface of the photoconductors 2Y, 2C, 2M, and 2BK, respectively, to a given polarity that is same as the toner applied with a predetermined potential.

In an exemplary embodiment of the present invention, the photoconductors 2Y, 2C, 2M, and 2BK are charged to a minus polarity as the toner is charged to a minus polarity.

As an alternative to the charging rollers 3Y, 3C, 3M, and 3BK having a shape of a roller, a different type charging member such as a charging brush or so forth can also be applied to the image forming apparatus 100 according to the present invention.

The developing units 4Y, 4C, 4M, and 4BK are arranged to have given intervals with respect to respective circumferential surfaces of the photoconductors 2Y, 2C, 2M, and 2BK, respectively.

The developing units 4Y, 4C, 4M, and 4BK include developing sleeves 41Y, 41C, 41M, and 41BK, respectively.

The developing sleeves 41Y, 41C, 41M, and 41BK may be formed in a cylindrical shape including non-magnetic stainless steel or aluminum material and rotate in a same direction as the rotations of the photoconductors 2Y, 2C, 2M, and 2BK.

The developing units 4Y, 4C, 4M, and 4BK may accommodate one of one-component and two-component developer of yellow color (Y), magenta color (M), cyan color (C), and black color (BK).

In an exemplary embodiment of the present invention, the developing units 4Y, 4C, 4M, and 4BK accommodate two-component developer including toner and magnetic carriers.

Toner is supplied from a toner storing unit (not shown) that contains a corresponding color of toner, to the corresponding one of the developing units 4Y, 4C, 4M, and 4BK via a path connected between the toner storing unit and the corresponding one of the developing units 4Y, 4C, 4M, and 4BK. Respective toners having different colors are supplied from respective directions indicated by arrows shown in FIG. 1.

The toner of the two-component developer for an exemplary embodiment of the present invention may be charged to a minus polarity.

For developing the two-component developer, each of the developing sleeves 41Y, 41C, 41M, and 41BK may include a magnet roller (not shown).

The magnet roller may include a plurality of stationary magnets or a plurality of magnetic polar regions.

When focusing on one developing unit, the developing unit 4Y may further include agitating and conveying members 42 that convey the two-component developer in the developing unit 4Y while conveying the developer, and a toner receiving portion 43. Since the structure and functions of the developing units 4Y, 4C, 4M, and 4BK are similar to each other, except for colors of toner accommodated therein, the developing units 4C, 4M, and 4BK may include respective agitating and conveying members 42 and respective toner receiving portions 43. However, the agitating and conveying members 42 and respective toner receiving portions 43 for the developing units 4C, 4M, and 4BK are not shown in FIG. 1.

The developing units 4Y, 4C, 4M, and 4BK may further include respective toner density sensors (not shown).

The developing sleeves 41Y, 41C, 41M, and 41BK of the corresponding developing units 4Y, 4C, 4M, and 4BK may further include respective rollers (not shown) to use for forming a given amount of gap between the surfaces of the developing sleeves 41Y, 41C, 41M, and 41BK and the surfaces of photoconductors 2Y, 2C, 2M, and 2BK.

Specifically, the developing sleeves 41Y, 41C, 41M, and 41BK may face in a non-contact manner with the corresponding photoconductors 2Y, 2C, 2M, and 2BK, with a gap in a range from approximately 100 μm to approximately 500 μm therebetween.

By applying a developing bias superimposing a direct voltage with an alternating voltage to the developing sleeves 41Y, 41C, 41M, and 41BK, a direct or indirect reversal developing may be conducted to form respective toner images on the surfaces of the photoconductors 2Y, 2C, 2M, and 2BK.

Each of the cleaning units 6Y, 6C, 6M, and 6BK include a cleaning blade 61 and a cleaning roller 62 or cleaning brush.

The cleaning blade 61 may be held in contact with the surface of each of the photoconductors 2Y, 2C, 2M, and 2BK in a counter manner of the rotational direction of the photoconductors 2Y, 2C, 2M, and 2BK.

The optical writing device (not shown) may be disposed at a downstream side of the charging rollers 3Y, 3C, 3M, and 3BK and at an upstream side of the developing units 4Y, 4C, 4M, and 4BK in the rotational direction of the photoconductors 2Y, 2C, 2M, and 2BK, respectively.

The optical writing device may be arranged in parallel with the rotational axis of the photoconductors 2Y, 2C, 2M, and 2BK so as to emit the laser light beams LY, LC, LM, and LBK in a main scanning direction.

The optical writing device may be provided with a light source including semiconductor laser diodes (LD), a coupling optical system or beam shaper including collimating lens and cylindrical lens, an optical deflector including a polygon mirror and so forth, and image forming optical system that may collect laser light beams deflected by the optical deflector.

Image data for each color may be obtained by reading an original document by an image reading device (not shown) provided in the image forming apparatus 100 and stored in a memory. Image data may also be obtained by receiving from an external device such as a personal computer. Based on such image data, the laser light beams LY, LC, LM, and LBK may be deflected and emitted to expose respective photoconductive layers of the photoconductors 2Y, 2C, 2M, and 2BK.

Specifically, the optical writing device emits laser light beams LY, LC, LM, and LBK to irradiate the photoconductors 2Y, 2C, 2M, and 2BK, respectively, via paths between the charging roller 3Y and the developing unit 4Y, between the charging roller 3C and the developing unit 4C, between the charging roller 3M and the developing unit 4M, and between the charging roller 3BK and the developing unit 4BK, respectively, in a direction indicated by respective arrows shown by a dashed-dotted line in FIG. 1.

Accordingly, respective single color toner images may be formed on the corresponding surfaces of the photoconductors 2Y, 2C, 2M, and 2BK.

As an alternative to the optical writing device having a laser exposure method as described above, an optical writing device that employs a LED writing method that uses light-emitting diode arrays or LED arrays in combination of lens arrays and so forth.

The intermediate transfer belt 7 serves as an intermediate transfer member. The intermediate transfer belt 7 is formed in an endless shape that is extendedly arranged in a horizontal manner.

Specifically, the intermediate transfer belt 7 shown in FIG. 1 is extended by or spanned around an intermediate transfer belt drive roller (also serving as a secondary transfer backup roller) 8, an intermediate transfer belt supporting roller 9, intermediate transfer belt tension rollers 10*a* and 10*b*, and a backup roller 11 so as to be supported at the internal surface thereof.

Hereinafter, the intermediate transfer belt drive roller (also serving as secondary transfer backup roller) 8 may be referred to as an "intermediate transfer belt drive roller 8."

The intermediate transfer belt 7 rotates or travels in a counterclockwise direction indicated by an arrow in FIG. 1.

The intermediate transfer belt 7 receives respective toner images formed on the plurality of photoconductors 2Y, 2C, 2M, and 2BK. The respective toner images are attracted by the plurality of primary transfer rollers 5Y, 5C, 5M, and 5BK that may be respectively corresponding to the plurality of photoconductors 2Y, 2C, 2M, and 2BK, and primarily transferred onto a surface of the intermediate transfer belt 7 in an overlaying manner to form a full-color toner image.

Along a lower surface portion of the intermediate transfer belt 7 that runs in a horizontal manner, the plurality of image forming devices 1Y, 1C, 1M, and 1BK are arranged so as to be held in contact with the intermediate transfer belt 7 in a horizontal manner.

The secondary transfer roller 14 serves as a secondary transfer member so as to secondarily transfer the full color toner image formed on the surface of the intermediate transfer belt 7 onto a transfer sheet S that serves as recording medium.

The secondary transfer roller 14 is arranged to face the intermediate transfer belt drive roller 8 that rotates in a direction indicated by an arrow shown in FIG. 1. The secondary transfer roller 14 and the intermediate transfer belt drive roller 8 are disposed sandwiching the intermediate transfer belt 7 therebetween.

Accordingly, the secondary transfer roller 14 can contact with and separate from the intermediate transfer belt 7.

Specifically, the secondary transfer roller 14 may be controlled to contact with the intermediate transfer belt 7 for the image forming operation and to separate from the intermediate transfer belt 7 for the image adjustment operation.

The intermediate transfer belt 7 further includes a belt cleaning unit 12 that includes a cleaning blade 12*a*.

The belt cleaning unit 12 removes residual toner remaining on the surface of the intermediate transfer belt 7 to cause the intermediate transfer belt 7 ready for the next image forming operation.

The cleaning blade 12*a* may be disposed in the vicinity of the intermediate transfer belt supporting roller 9 with the intermediate transfer belt 7 sandwiched therebetween. The cleaning blade 12*a* may be held in contact with the intermediate transfer member 7 in a counter manner of the rotational direction of the intermediate transfer member 7.

The primary transfer rollers 5Y, 5C, 5M, and 5BK may also be arranged to face the photoconductors 2Y, 2C, 2M, and 2BK, respectively, sandwiching the intermediate transfer belt 7.

The intermediate transfer belt 7 shown in FIG. 1 forms an endless belt having a volume resistivity in a range from approximately $10^9$ Ω·cm to approximately $10^{12}$ Ω·cm.

The intermediate transfer belt 7 may include, for example, a resin material or a rubber material, into either of which an electrically conductive filler such as carbon is dispersed or ionic conductive material is contained.

The resin material may include polycarbonate (PC), polyimide (PI), polyamide-imide (PAI), polyvinylidene-fluoride (PVDF), ethylene-tetrafluoroethylene copolymer (ETFE) and so forth, for example.

The rubber material may include ethylene propylene diene methylene (EPDM), nitril butadiene rubber (NBR), chloroprene rubber (CR), polyurethane and so forth.

The thickness of the intermediate transfer belt 7 is preferably set in a range from approximately 50 μm to approximately 200 μm for a resin material or in a range from approximately 300 μm to approximately 700 μm for a rubber material.

Alternatively, the intermediate transfer belt 7 can have a rubber layer on a resin belt or have a coating layer on an upper surface thereof.

Further, to increase cleaning ability and to reduce or prevent possibility that toner adheres to the surface of the intermediate transfer belt 7, the intermediate transfer belt 7 can include a lubricant applying unit that may apply a fluoric resin release agent or lubricant to the surface thereof.

The intermediate transfer belt 7 is rotated with rotations of the intermediate transfer belt drive roller 8 that may be driven by a belt drive motor (not shown).

The intermediate transfer belt drive roller 8 may include a conductive cored bar (not shown) such as stainless steel, for example.

The conductive cored bar of the intermediate transfer belt drive roller 8 may include a circumferential surface that may be coated by a conductive or semi-conductive material in which a conductive filler such as carbon may be dispersed to either of a rubber material such as polyurethane, EPDM, silicone and so forth or a resin material.

As previously described, the primary transfer rollers 5Y, 5C, 5M, and 5BK that serve as primary transfer member are arranged to face the photoconductors 2Y, 2C, 2M, and 2BK, respectively. With such configuration, the primary transfer rollers 5Y, 5C, 5M, and 5BK form respective primary transfer portions with respect to the photoconductors 2Y, 2C, 2M, and 2BK on the outer surface of the intermediate transfer belt 7.

A direct current power source (not shown) provided in the image forming apparatus 100 may apply a direct voltage to the primary transfer rollers 5Y, 5C, 5M, and 5BK to a given polarity that is opposite to the toner applied to a given potential so as to form a transfer electric field in the respective primary transfer portions.

In an exemplary embodiment of the present invention, the primary transfer rollers 5Y, 5C, 5M, and 5BK are charged to a plus polarity since the toner is charged to a minus polarity as previously described.

As the primary transfer rollers 5Y, 5C, 5M, and 5BK form the transfer electric field, respective single color toner images formed on the surfaces of the photoconductors 2Y, 2C, 2M, and 2BK may be attracted and transferred onto the surface of the intermediate transfer belt 7.

The primary transfer rollers 5Y, 5C, 5M, and 5BK that may include a conductive cored bar (not shown) such as stainless steel having a diameter of approximately 8 mm, for example.

The conductive cored bar of the primary transfer rollers 5Y, 5C, 5M, and 5BK may include a circumferential surface that may be coated by a semi-conductive elastic rubber material (not shown), into which an electrically conductive filler such as carbon may be dispersed to or ionic conductive material may be conducted to a rubber material such as polyurethane, EPDM, silicone and so forth.

The semi-conductive elastic rubber material may be provided in a solid form or a foamed sponge form, having a volume resistivity in a range from approximately $10^5$ Ω·cm to approximately $10^9$ Ω·cm. The semi-conductive elastic rubber material may have the thickness of approximately 5 mm and a hardness in a range from approximately 20 degrees to approximately 70 degrees, which corresponds to Asker-C.

The secondary transfer roller 14 serving as a secondary transfer member transfers the full color toner image on the intermediate transfer belt 7 onto the transfer sheet S.

As previously described, the secondary transfer roller 14 is arranged to face the intermediate transfer belt drive roller 8, sandwiching the intermediate transfer belt 7.

The direct current power source (not shown) may apply a direct voltage to the secondary primary transfer roller 14 to a given polarity that is opposite to the toner applied to a given potential. Accordingly, the full color toner image formed on the surface of the intermediate transfer belt 7 may be attracted by the secondary transfer roller 14 and be transferred in a secondary transfer portion onto a surface of the transfer sheet S.

The secondary transfer roller 14 may include a conductive cored bar (not shown) such as stainless steel having a diameter of approximately 16 mm, for example.

The conductive cored bar of the secondary transfer roller 14 may include a circumferential surface that may be coated by a semi-conductive elastic rubber material (not shown), into which an electrically conductive filler such as carbon may be dispersed to or ionic conductive material may be conducted to a rubber material such as polyurethane, EPDM, silicone and so forth.

The semi-conductive elastic rubber material may be provided in a solid form or a foamed sponge form, having a volume resistivity in a range from approximately $10^5$ Ω·cm to approximately $10^9$ Ω·cm. The semi-conductive elastic rubber material may have the thickness of approximately 7 mm and a hardness in a range from approximately 20 degrees to approximately 70 degrees, which corresponds to Asker-C.

While the primary transfer rollers 5Y, 5C, 5M, and 5BK do not directly contact with toner, the secondary transfer roller 14 contacts with toner at the secondary transfer portion. Therefore, the surface of the secondary transfer roller 14 may be coated by a semi-conductive fluoric resin or urethane resin, which can enhance the releasing ability of toner.

Further, as previously described, the intermediate transfer belt drive roller 8 includes a conductive cored bar (not shown) such as stainless steel.

The conductive cored bar of the intermediate transfer drive roller 8 may include a circumferential surface that may be coated by a semi-conductive material (not shown), into which an electrically conductive filler such as carbon may be dispersed to or ionic conductive material may be conducted to a rubber material such as polyurethane, EPDM, silicone and so forth or a resin material.

The semi-conductive material may have the thickness in a range from approximately 0.05 mm to approximately 0.5 mm.

The cleaning blade 61 for each of the photoconductors 2Y, 2C, 2M, and 2BK and the cleaning blade 12*a* for the intermediate transfer belt 7 include a steel-plated holder that may be coated by a sheet-like urethane rubber having a thickness in a range from approximately 1 mm to approximately 3 mm and a JIS-A hardness in a range from approximately 60 degrees to approximately 80 degrees.

The cleaning blade 61 for each of the photoconductors 2Y, 2C, 2M, and 2BK and the cleaning blade 12*a* for the intermediate transfer belt 7 have a free length in a range from approximately 5 mm to approximately 12 mm, and are held in contact with each of the photoconductors 2Y, 2C, 2M, and 2BK and the intermediate transfer belt 7, respectively, at a loading amount of from approximately 5 gf to approximately 50 gf.

To reduce or prevent, if possible, the curling of the cleaning blade 61 of each of the photoconductors 2Y, 2C, 2M, and 2BK and the cleaning blade 12*a* of the intermediate transfer belt 7, a fluorine-containing coating may be conducted at the leading edge of the cleaning blades 61 and 12*a* or a conductive urethane rubber may be provided so as not to charge the photoconductors 2Y, 2C, 2M, and 2BK and/or the cleaning blade 12*a*.

Now, operations of forming an image are described below.

The respective charging rollers 3Y, 3C, 3M, and 3BK uniformly charge respective surfaces of the plurality of photoconductors 2Y, 2C, 2M, and 2BK.

The optical writing device emits the laser light beams LY, LC, LM, and LBK and irradiates the respective surfaces of the plurality of photoconductors 2Y, 2C, 2M, and 2BK so as to form respective electrostatic latent images thereon.

The developing units 4Y, 4C, 4M, and 4BK develop the respective electrostatic latent images into respective toner images.

The primary transfer rollers 5Y, 5C, 5M, and 5BK applied with a predetermined voltage attract the respective toner images to primarily transfer the respective toner images onto the intermediate transfer belt 7 at the respective primary transfer portions. The respective toner images are sequentially overlaid to a full color toner image.

When the full color toner image formed in an overlaid manner on the intermediate transfer belt 7 is conveyed to the secondary transfer portion, the secondary transfer roller 14 applied with a predetermined voltage attracts the full color toner image to secondary transfer the full color toner image onto the transfer sheet S.

The transfer sheet S is accommodated in a sheet feeding device (not shown) that may include at least one sheet feeding cassette, at least one sheet feeding tray, and so forth.

The transfer sheet S is fed by a sheet feeding roller (not shown) toward a pair of registration rollers 13.

The pair of registration rollers 13 stops and feeds the transfer sheet S in synchronization with a movement of the intermediate transfer belt 7.

The transfer sheet S is conveyed to the secondary transfer portion formed between the secondary transfer roller 14 and the intermediate transfer belt drive roller 8.

At the secondary transfer nip, the transfer sheet S is overlapped with the intermediate transfer belt 7 so that the full color image formed on the intermediate transfer belt 7 can be transferred onto the transfer sheet S.

The transfer sheet S having the full-color image thereon is then conveyed to the fixing device 15 so as to fix the full color image onto the transfer sheet S by applying heat by a fixing roller 15*a* and pressure by a pressure roller 15*b*.

Finally, the transfer sheet S is discharged to a sheet discharging portion (not shown).

Thus, the image forming apparatus 100 conducts a series of image forming operations.

In an exemplary embodiment of the present invention, the charging rollers 3Y, 3C, 3M, and 3BK may be used to serve as charging member so as to charge the photoconductors 2Y, 2C, 2M, and 2BK, respectively, and the primary transfer rollers 5Y, 5C, 5M, and 5BK may be used to serve as primary transfer member to primarily transfer respective toner images. By using these members, the image forming apparatus 100 can contribute to a reduction of production and emission of ozone that is environmentally harmful.

The charging rollers 3Y, 3C, 3M, and 3BK and the primary transfer rollers 5Y, 5C, 5M, and 5BK are applicable to the present invention, however, a charging member and a primary transfer member are not limited to the above-described members.

As an alternative, the present invention can use the corotron charging members or units by applying to a non-contact charging member or primary transfer member.

In the image forming apparatus 100 according to an exemplary embodiment of the present invention, respective toner images formed on the photoconductors 2Y, 2C, 2M, and 2BK are primarily transferred onto the intermediate transfer belt 7 in a manner of forming an overlaid full-color toner image, then the full-color toner image is secondary transferred onto a transfer sheet S.

With the above-described configuration, the image forming apparatus 100 may conduct a series of image forming operations for producing images or printed copies.

Hereinafter, this image forming operations for producing images may be referred to as a "regular image forming operation."

In addition to the regular image forming operation, the image forming apparatus 100 of FIG. 1 conducts a series of operation for adjusting images. Hereinafter, the series of operations for adjusting images may be referred to as an "image adjustment operation" or an "image forming process control."

The image forming apparatus further 100 of FIG. 1 includes optical sensors 16 at the downstream side of the rotational direction of the intermediate transfer belt 7 and at a position to face the surface of the intermediate transfer belt 7.

Each of the optical sensors 16 included in the image forming apparatus 100 is a light reflection type photosensor including a light-emitting element and a light-receiving element, for example.

The optical sensors 16 detect respective amounts of toner density in the two-component developer accommodated in the developing units 4Y, 4C, 4M, and 4BK, when necessary. That is, the optical sensors 16 is used to detect the amounts of toner adhered to respective patterns for image adjustment. Details of the optical sensors 16 will be described later.

The image forming apparatus 100 conducts image adjusting operations or a process control, as well as the regular image forming operations.

In the image adjusting operation or the process control, the image forming apparatus 100 may cause toner patterns for image adjustment or image adjustment patterns to be formed in respective non-image forming areas of the photoconductors 2Y, 2C, 2M, and 2BK.

The image adjustment patterns may be transferred onto the intermediate transfer belt 7 so that the optical sensors 16 can detect respective amounts of toner adhered to the image adjustment patterns.

According to the detection result obtained by the optical sensor 16, a control unit (not shown) provided in the image forming apparatus 100 may adjust image forming conditions for a next image forming operation so as to produce an optimal image or may optimize the supplying amount of toner for controlling the toner density.

The control unit may include a microcomputer such as a micro processing unit (MPU) or central processing unit (CPU).

Further, the control unit may control a setting of a timing of separation and contact operations of the secondary transfer roller 14, so as to obtain effective productivity of copies and printouts while reducing or preventing adverse affect on image quality.

The control unit may include the microcomputer (CPU or MPU) serving as a main controller, a storing unit or memory that may store control programs and data therein, an input unit that may receive the results output from the optical sensor to the microcomputer (CPU), an output unit that may output control signals issued by the microcomputers (CPU) to control circuits of various devices in the image forming apparatus 100, a clock for measuring time, a timer, and so forth.

In an exemplary embodiment of the present invention, the image forming apparatus 100 is designed to conduct detection of respective toner patterns of yellow color (Y), cyan color (C), magenta color (M), and black color (BK) as fast as possible. Therefore, light reflection type photosensors included in the optical sensors 16 may be disposed at a downstream side of the secondary transfer roller 14 in the rotational direction of the intermediate transfer belt 7, facing downwardly with respect to the surface of the intermediate transfer belt 7, so that the optical sensors 16 can avoid contamination due to toner dispersion or toner scattering.

Further, the image forming apparatus 100 according to an exemplary embodiment of the present invention includes four sets of optical sensors 16 so that each of the optical sensors 16 can be provided for each color toner by the same number, which is four. The four sets of optical sensors 16 are disposed in the moving direction of the intermediate transfer belt 7 so that the optical sensors 16 can detect respective amounts of toner adhered to the corresponding toner images at the same time.

As previously described, the secondary transfer roller 14 according to an exemplary embodiment of the present invention is held in contact with the surface of the intermediate transfer belt 7. As a result, the secondary transfer roller 14 can reduce the production and emission of ozone and can provide the better conveying ability of a transfer sheet S, when compared with a case using a non-contact, discharging type corotron.

However, since the secondary transfer roller 14 is used while being held in contact with the intermediate transfer belt 7, the secondary transfer roller 14 may need to be detached or separate from the intermediate transfer belt 7 when the above-described image adjustment patterns are detected.

Specifically, the image adjustment patterns formed in the non-image forming areas of the photoconductors 2Y, 2C, 2M, and 2BK are transferred onto the intermediate transfer belt 7, and the optical sensors 16 disposed at the downstream side of the secondary transfer roller 14 in the rotational direction of the intermediate transfer belt 7 detect respective amounts of reflected light or respective amounts of toner adhered to the corresponding image adjustment patterns.

At this time, the image adjustment patterns formed on the intermediate transfer belt 7 may need to be detected without being adversely affected by any mechanical impact or vibration. Therefore, the secondary transfer roller 14 may need to separate from the intermediate transfer belt 7.

The image adjustment patterns formed on the non-image forming area of each of the image bearing members 2Y, 2C, 2M, and 2BK are primarily transferred onto the surface of the intermediate transfer member 7.

To detect the amounts of toner adhered to respective image adjustment patterns, the optical sensors 16 are disposed at a downstream side of the secondary transfer portion in the moving or rotational direction of the intermediate transfer member 7 in a face-down manner, as previously described.

Based on the detected results of the optical sensors 16, the image forming apparatus 100 conducts the process control by changing image forming conditions.

The above-described possible mechanical impact or vibration may be caused when separating the secondary transfer roller 14 from the intermediate transfer belt 7. Such mechanical impact or vibration can cause an adverse affect to production of toner images. Specifically, such mechanical impact or vibration can cause any damage to a production of image adjustment patterns for the image adjusting operation, which can result in the production of defective images.

Therefore, in an exemplary embodiment of the present invention, the secondary transfer roller 14 may separate from the intermediate transfer belt 7 during a period of time in which the above-described operation no longer affects the image production.

Specifically, the secondary transfer roller 14 may separate from the intermediate transfer belt 7 before the most upstream image forming device (e.g., the image forming device 1Y in the image forming apparatus 100 according to an exemplary embodiment of the present invention) is first to receive the corresponding laser light beam LY corresponding to the electrostatic latent image of the image forming device 1Y.

With such operation, the image forming apparatus 100 can surely conduct the image forming operations, for example, optically writing respective electrostatic latent images onto the corresponding photoconductors 2Y, 2C, 2M, and 2BK, developing the electrostatic latent images into toner images, and primarily transferring the toner images onto the intermediate transfer belt 7.

It is noted that the above-described operations may be applied to form a single pattern.

Figure 2:
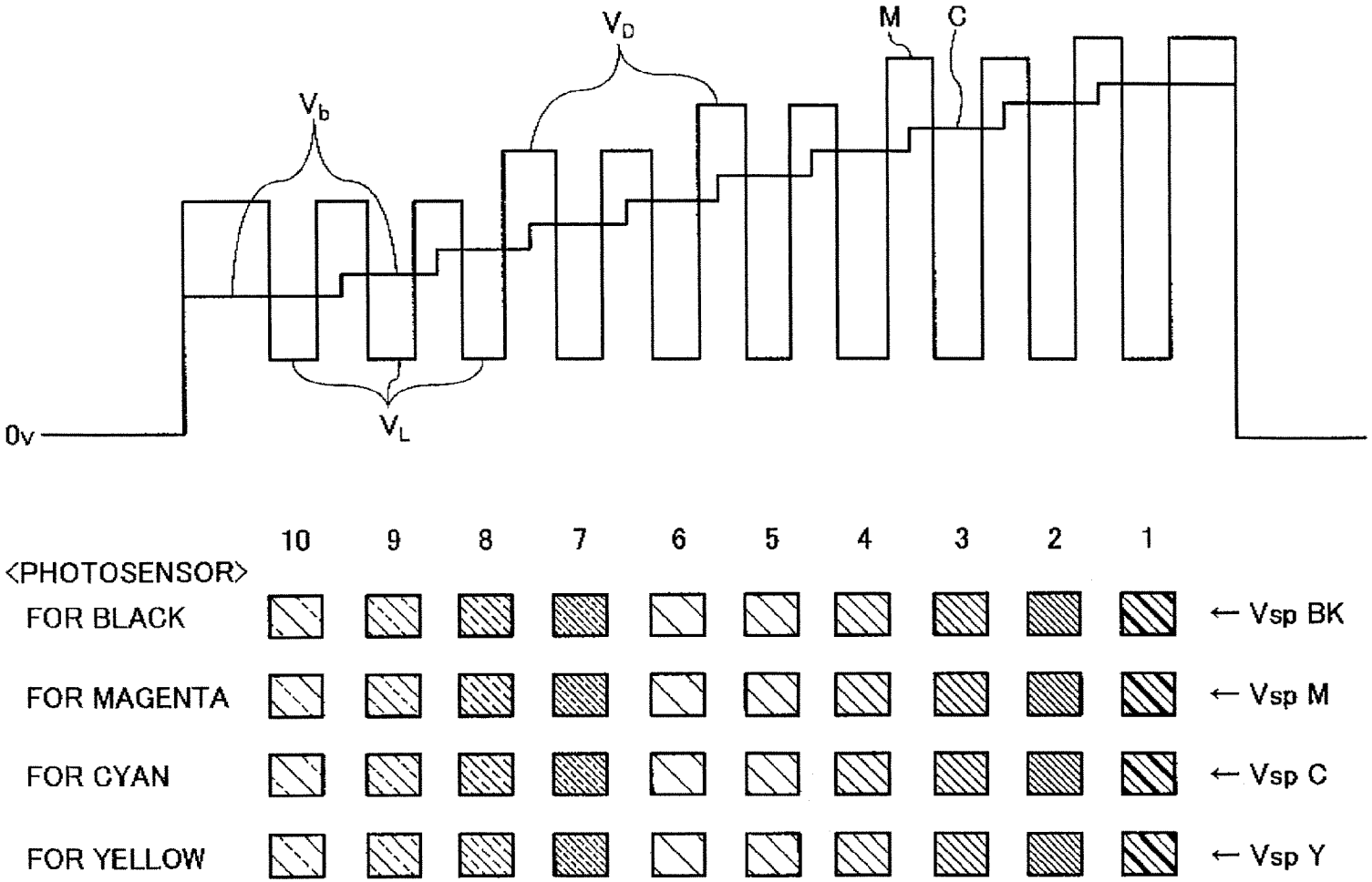
FIG. 2 is a schematic diagram showing one example of image adjustment patterns for the image forming apparatus of FIG. 1 according to at least one exemplary embodiment of the present invention.

When controlling image forming conditions, for example, adjusting a development bias, a plurality of image adjustment patterns having different amounts of toner adhered thereto are formed, as shown in FIG. 2, so that the optical sensors 16 can detect the amounts of toner for the plurality of image adjustment patterns.

In the above-described case, however, the optical sensors 16 may take long time to form and detect all the plurality of image adjustment patterns.

Specifically, when a plurality of image adjustment patterns are formed on the intermediate transfer member 7 in a circumferential direction or travel direction of the intermediate transfer member 7, the operations for forming the image adjustment patterns may take a long time. Therefore, the timing of separating the secondary transfer member 14 from the intermediate transfer belt 7 may need to be changed to reduce the amount of time that is wasted.

Further, the plurality of image adjustment patterns may be detected by the optical sensors 16 disposed at the downstream side of the secondary transfer roller 14 in the rotation direction of the intermediate transfer belt 7. Therefore, when the plurality of image adjustment patterns pass the secondary transfer area, the secondary transfer roller 14 may need to separate from the intermediate transfer belt 7 so as to form toner images without any image defect.

In a case in which the plurality of image adjustment patterns has not been completely transferred onto the surface of the intermediate transfer belt 7 even when the leading pattern of the plurality of image adjustment patterns reaches the secondary transfer roller 14, residual image adjustment patterns that remain untransferred to the intermediate transfer belt 7 may need to be transferred during the operation of separating the secondary transfer roller 14 from the intermediate transfer belt 7.

Thus, when forming a plurality of image adjustment patterns, the image forming apparatus 100 may need to control the separation timing of the secondary transfer roller 14 so as to separate from the intermediate transfer belt 7 at a timing that the leading pattern of the plurality of image adjustment patterns reaches immediately before the secondary transfer roller 14.

Figure 3:
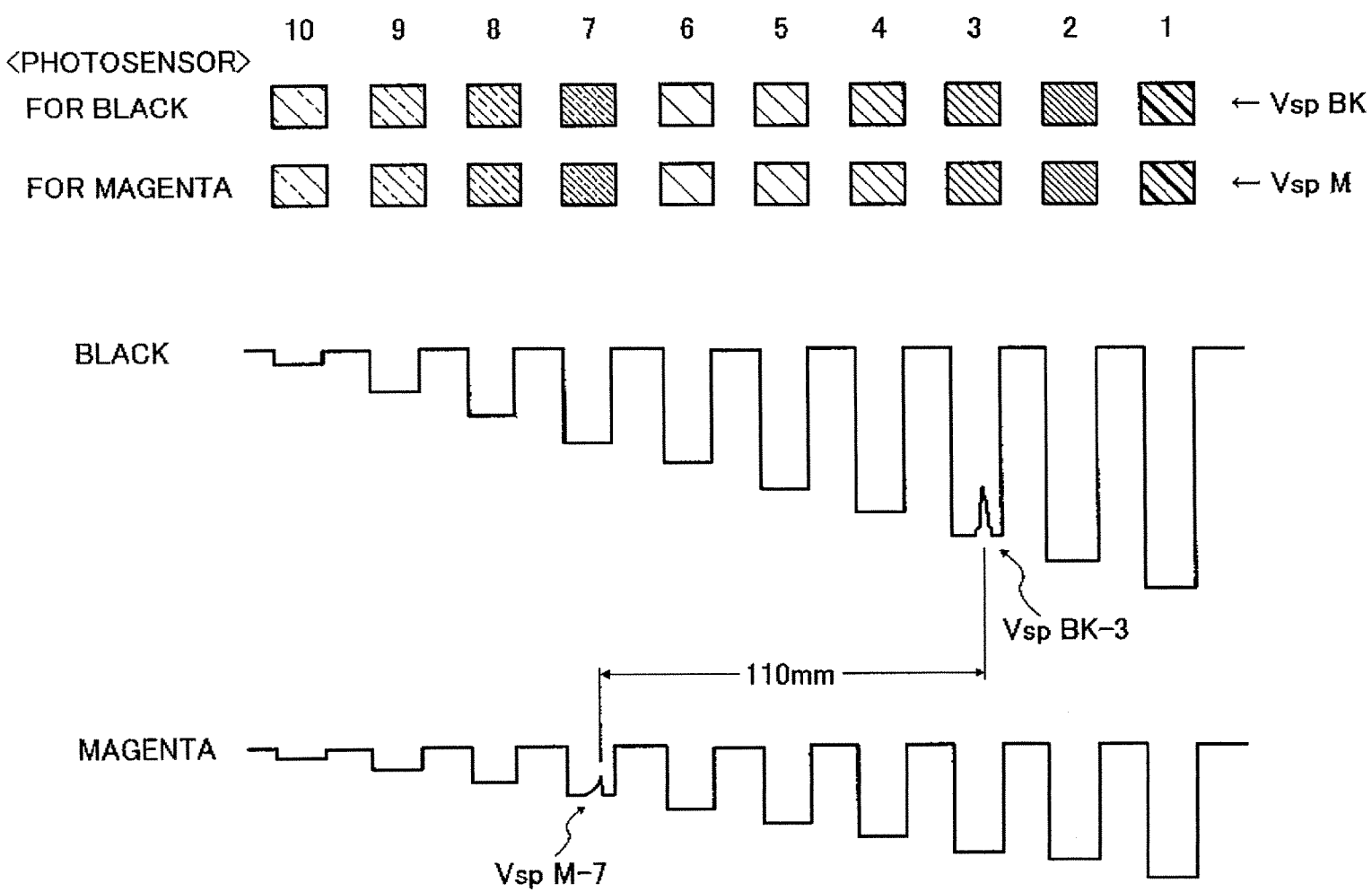
FIG. 3 is a schematic diagram showing another example of image adjustment patterns for the image forming apparatus of FIG. 1 according to at least one exemplary embodiment of the present invention.

Referring to FIGS. 2 and 3, schematic drawings of image adjustment patterns formed for the image forming apparatus 100 are described.

In FIGS. 2 and 3, the image adjustment patterns 1 through 10 having the plurality of toner colors with different tones per level are shown in identical tone for each pattern image. However, pattern images having different tone in an identical design between toner colors may be printed and formed in different colors. For example, the density of the 7th pattern image are same between image patterns for yellow, cyan, magenta, and black colors.

Figure 4:
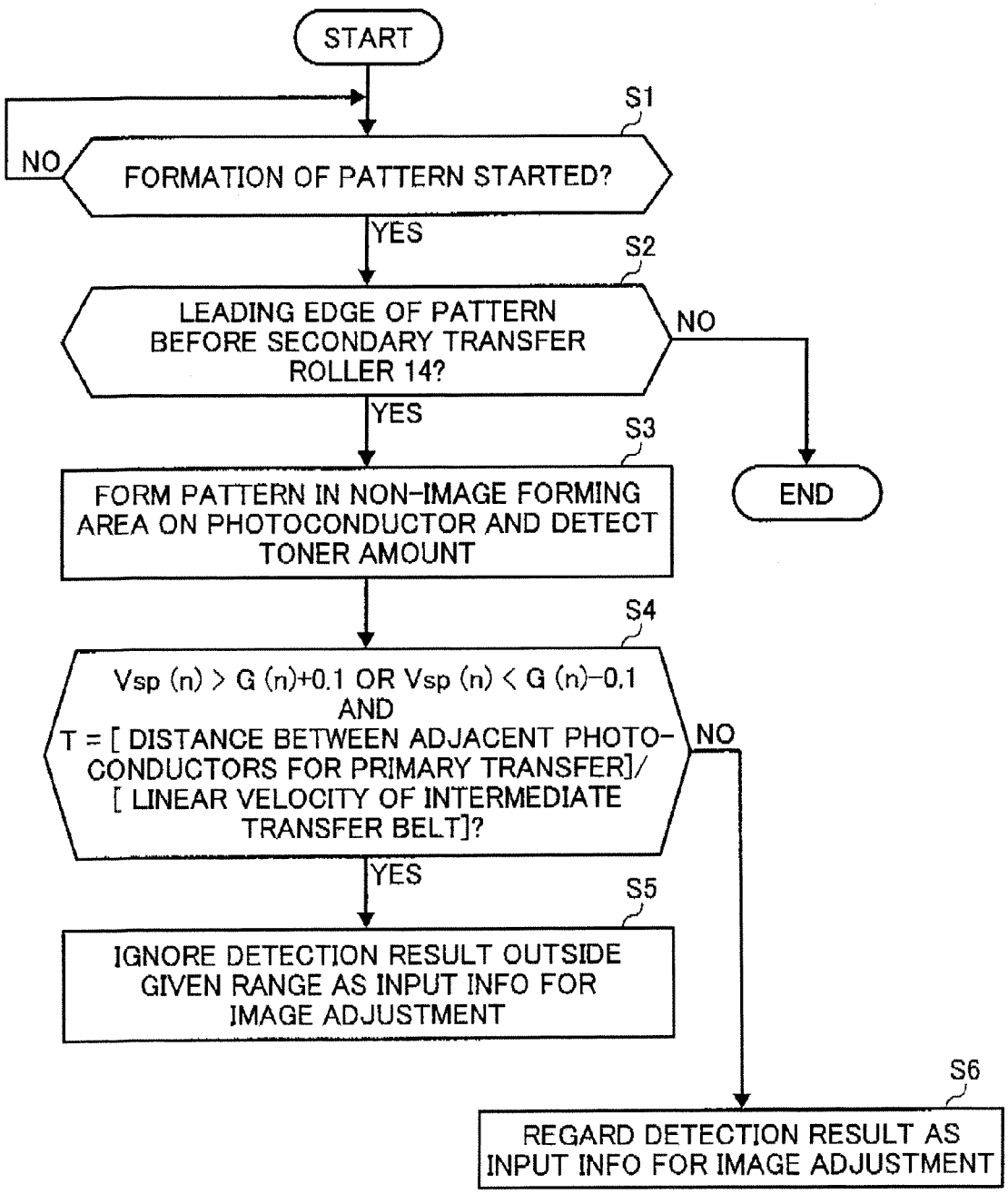
FIG. 4 is a flowchart showing a procedure of image forming process control for image adjustment in the image forming apparatus of FIG. 1 according to at least one exemplary embodiment of the present invention.

Referring to FIG. 4, a flowchart showing a procedure of an image forming process control for image adjustment is described.

In step S1 of the procedures of the image forming process control, it is determined whether the image forming operation for forming a plurality of image adjustment patterns has started.

When it is determined that the image forming operation has started, the process proceeds to step S2.

When it is determined that the image forming operation has not started yet, the process repeats step S1.

In step S2, it is determined whether the leading edge of the plurality of image adjustment patterns has been conveyed before the secondary transfer roller 14.

When it is determined that the leading edge of the plurality of image adjustment patterns has been conveyed before the secondary transfer roller 14, the process proceeds to step S3.

When it is determined that the leading edge of the plurality of image adjustment patterns has not yet been conveyed before the secondary transfer roller 14, the process ends the procedure.

In step S3, the image forming apparatus 100 causes the plurality of image adjustment patterns to be formed in a non-image forming area on the plurality of photoconductors 2Y, 2C, 2M, and 2BK, and the optical sensors 16 to detect respective amounts of toner adhered on the plurality of respective image adjustment patterns. Then, the process proceeds to step S4.

In step S4, a detection result is determined whether to satisfy an equation of state, "$Vsp(n)>G(n)+0.1$" or an equation of state, "$Vsp(n)<G(n)-0.1$", and whether to satisfy an equation, "T=[Distance between Adjacent Photoconductors for Primary Transfer]/[Linear Velocity of the Intermediate Transfer Belt].

When the detection result is determined to satisfy both of the conditions, the process proceeds to step S5.

When the detection result is determined not to satisfy both of the conditions, the process proceeds to step S6.

In step S5, the image forming apparatus 100 determines to ignore the detection result that falls outside a given range as input information for image adjustment.

In step S6, the image forming apparatus 100 determines to regard the detection result as input information for image adjustment.

Specifically, the image forming apparatus 100 according to an exemplary embodiment of the present invention may cause the secondary transfer roller 14 to separate from the intermediate transfer belt 7 after the image forming device 1Y for yellow color (Y) toner has started the image forming operation but before the leading pattern of the plurality of image adjustment patterns reaches the secondary transfer roller 14.

At this time, the mechanical impact or vibration caused due to the separating operation of the secondary transfer roller 14 can be transmitted to the image forming devices 1Y, 1C, 1M, and 1BK, resulting in defects in the image adjustment patterns.

Generally, output values or detection results of the plurality of image adjustment patterns obtained by the optical sensor 16 within one image adjustment pattern may be substantially constant.

In a case in which one optical sensor 16 detects a different output value or different detection result of the plurality of image adjustment patterns compared with the other output values, the output value different from the others may be regarded as an irregular value.

If the output values including such irregular value(s) of the image adjustment pattern are calculated, severe errors may occur in the amount of density of toner adhered to the image adjustment pattern, and may result in a production of an image with unstable image density control.

In an exemplary embodiment of the present invention, the irregularity or change in output values or detection results by the optical sensor 16 may be determined as follows.

For conducting the image adjustment operation, the photoconductors 2Y, 2C, 2M, and 2BK may form the image adjustment patterns on respective non-image forming areas thereof.

The optical sensors 16, which may be disposed in a downwardly facing manner at the downstream side of the secondary transfer portion in the rotational direction of the intermediate transfer belt 7, may detect amounts of toner adhered to each of the image adjustment patterns.

The optical sensors 16 may check whether each output value with respect to the image adjustment patterns of the plurality of image forming devices 1Y, 1C, 1M, and 1BK satisfies the following equation of state, $$Vsp(n)>G(n)+0.1 \text{ or } Vsp(n)<G(n)-0.1 \qquad \text{Equation 1,}$$

wherein "Vsp" represents an output value of the image adjustment pattern obtained by the optical sensor 16, "G" represents a target value of the image adjustment pattern, and "n" represents the ordinal number of each image adjustment pattern provided for each color.

Specifically, it is determined whether each output value of the image adjustment pattern meets Equation 1 or falls in a range of $G(n)+0.1 \geqq Vsp(n) \geqq G(n)-0.1$, which is outside the range of Equation 1.

Further, among the output values obtained by the respective optical sensors 16 provided for adjacent image forming devices A and B, a detection interval time "T" (detection interval time T of Vsp(n) for color A and Vsp(n) for color B) of an output value that satisfies the above-described Equation 1 is expressed in the following equation:

$$T=[\text{distance between adjacent photoconductors of color } A \text{ and color } B \text{ for primary transfer}]/[\text{linear velocity of the intermediate transfer member}] \qquad \text{Equation 2.}$$

When the output value satisfies both Equations 1 and 2, it is determined that the output value that satisfies Equation 1 has been affected by impact or vibration caused when the secondary transfer roller 14 separates from the intermediate transfer belt 7.

Specifically, when an output value of a specific image adjustment pattern satisfies Equation 1, it is determined that the output value falls outside a given range for acceptable changed in output value of the optical sensor 16.

Accordingly, such output value that falls out of the given range may not be regarded as image adjustment input information.

Details of Equations 1 and 2 are now described, with reference to FIG. 2.

As shown in FIG. 2, ten (10) image adjustment patterns for each toner color are formed on the intermediate transfer belt 7 along the rotational or circumferential direction of the intermediate transfer belt 7, for example.

Specifically, ten image adjustment patterns for yellow color, ten image adjustment patterns for cyan color, ten image adjustment patterns for magenta color, and ten image adjustment patterns for black color are formed on the intermediate transfer belt 7.

Each of the ten image adjustment patterns for each color is formed in respectively different tones by changing respective amounts of applied charge voltage, development bias voltage, and light volume for writing, and by changing the amounts of toner adhered to the corresponding image adjustment pattern.

As described above, when one of the optical sensors 16 detects the n-th image adjustment pattern, the output value of the n-th image adjustment pattern can be represented as "Vsp (n)." The target value, "G(n)", may be previously determined for each color, and Vsp(n) may be generally included within a range from G(n)−0.1 to G(n)+0.1.

In the present invention, an interval of adjacent two image forming devices is set to be approximately 110 mm, for example.

When focusing on the image forming devices 1M and 1BK, the first image adjustment pattern of the image forming device 1BK may be formed after the first image adjustment pattern of the image forming device 1M by the detection interval time T obtained by Equation 2. Thereby, the first image adjustment patterns of the image forming devices 1M and 1BK may be formed on the intermediate transfer belt 7 in one line in an axial direction of the intermediate transfer belt 7, as shown in FIGS. 2 and 3.

With the above-described operation, the image adjustment patterns for each color may be formed in a parallel manner along the axial direction of the intermediate transfer belt 7. Further, the optical sensors 16 provided for respective colors may detect the image adjustment patterns of the same numbers (e.g., the tenth patterns for yellow, cyan, magenta, and black) in a synchronized manner.

For example, the secondary transfer member 14 separates from the intermediate transfer belt 7 while the third image adjustment pattern for black color is being formed.

Unfortunately, due to the impact or vibration caused by the separation of the secondary transfer member 14, the optical sensor 16 provided for detecting the black image adjustment patterns detects an irregular output value of the black pattern.

In such case, an output value of the third image adjustment pattern for black, "Vsp BK-3", may be irregularly fluctuated, and an output value of the seventh image adjustment pattern for magenta, "Vsp M-7", may be irregularly fluctuated, similarly to the output value of "Vsp BK-3."

The output value of the seventh image adjustment pattern for magenta, "Vsp M-7", may be formed at the upstream side by a distance between respective primary transfer areas of the image forming devices 1M and 1BK on the intermediate transfer belt 7.

As previously described, FIG. 2 shows an example of a plurality of image adjustment patterns for each color in different densities.

To form the plurality of image adjustments in FIG. 2, the photoconductors 2Y, 2C, 2M, and 2BK in a regular condition are charged to a given amount of charging voltage. The laser diodes (LD) of the optical writing device (not shown) emit laser light beams LY, LC, LM, and LBK to irradiate the photoconductors 2Y, 2C, 2M, and 2BK, respectively, so as to form respective electrostatic latent images on the photoconductors 2Y, 2C, 2M, and 2BK. The developing devices 4Y, 4C, 4M, and 4BK change the development bias voltage in steps so as to form the plurality of image adjustment patterns having different densities.

The above-described operation implemented for creating the plurality of image adjustment patterns of different densities as shown in FIG. 2 may be performed by using a sensor to measure the laser light intensity.

Figure 5:
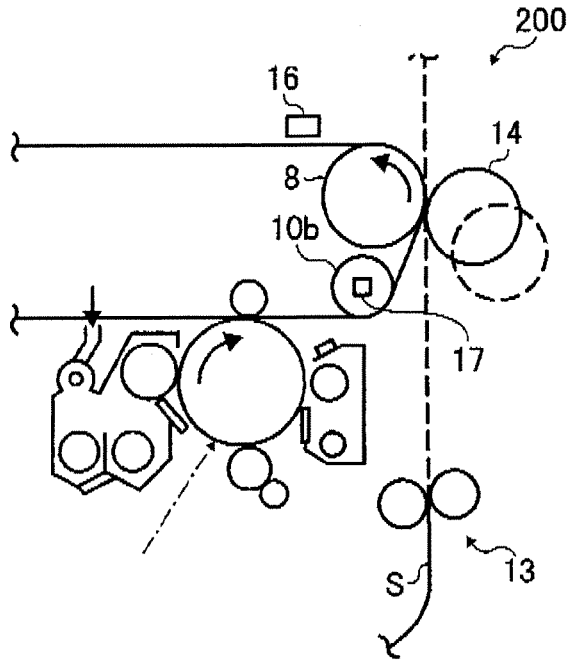
FIG. 5 is a schematic configuration of an image forming portion of a different image forming apparatus according to another exemplary embodiment of the present invention.

Referring to FIG. 5, a schematic configuration of an image forming apparatus 200 according to another exemplary embodiment of the present invention is described.

The image forming apparatus 200 according to this exemplary embodiment of the present invention may be basically similar to the image forming apparatus 100. Except, the image forming apparatus 200 may include a rotary encoder 17.

Detailed description for other similar image forming components and functions may be omitted.

The rotary encoder 17 that serves as a detection unit detects or determines whether any mechanical impact or vibration is caused to the plurality of image adjustment patterns due to the separation of the secondary transfer member 14 from the intermediate transfer belt 7.

The rotary encoder 17 in FIG. 5 is mounted on a driven roller, which may be the intermediate transfer belt tension roller 10*b* in an exemplary embodiment of the present invention, so as to detect changes in a rotational transfer velocity of the intermediate transfer belt 7.

When the secondary transfer roller 14 separates from the intermediate transfer belt 7, an output value of the rotary encoder 17 may change. Under this condition, it is determined whether the following relationship is satisfied:

$$Ve > Ge + 0.2 \text{ mm/sec or } Ve < Ge - 0.2 \text{ mm/sec} \qquad \text{Equation 3,}$$

wherein "Ve" represents a rotational transfer velocity of the intermediate transfer belt 7 and "Ge" represents a standard velocity of the intermediate transfer belt 7.

When the output value of the rotary encoder 17 satisfies the above-described Equation 3, it is determined that the secondary transfer member 14 can cause a mechanical impact or vibration that can adversely affect to the operation of forming a plurality of image adjustment patterns.

In other words, when the rotational transfer velocity "Ve" is included in a range of $Ge+0.2 \geqq V \geqq Ge-0.2$, it is determined that the detected output value is regarded as image adjustment input information for adjusting the image forming condition.

On the contrary, when the rotational transfer velocity "Ve" satisfies Equation 3 and is outside the range of $Ge+0.2 \geqq V \geqq Ge-0.2$, it is determined that the detected output value is ignored and not regarded as image adjustment input information for adjusting the image forming condition.

Similar to the previously described condition in which Equations 1 and 2 are satisfied, the image forming apparatus 200 may determine that the detected output values of the image adjustment patterns formed at the timing of which the secondary transfer roller 14 separates from the intermediate transfer belt 7 are not regarded as image adjustment input information for adjusting the image forming condition.

Alternative to the above-described operation by using the rotary encoder 17, any sensing unit that detects the rotational transfer velocity of an intermediate transfer member can be applied to the present invention.

For example, a plurality of scales may be mounted on the surface of the intermediate transfer belt 7 so that an optical sensor such as a light reflection type photosensor can regularly detect the plurality of scales to obtain the rotational velocity of the intermediate transfer belt 7.

Other than such scales, the present invention can apply barcodes, dots, or any other materials that may have similar size to each other so that the materials disposed at constant intervals can be read by a sensor or sensors.

Figure 6:
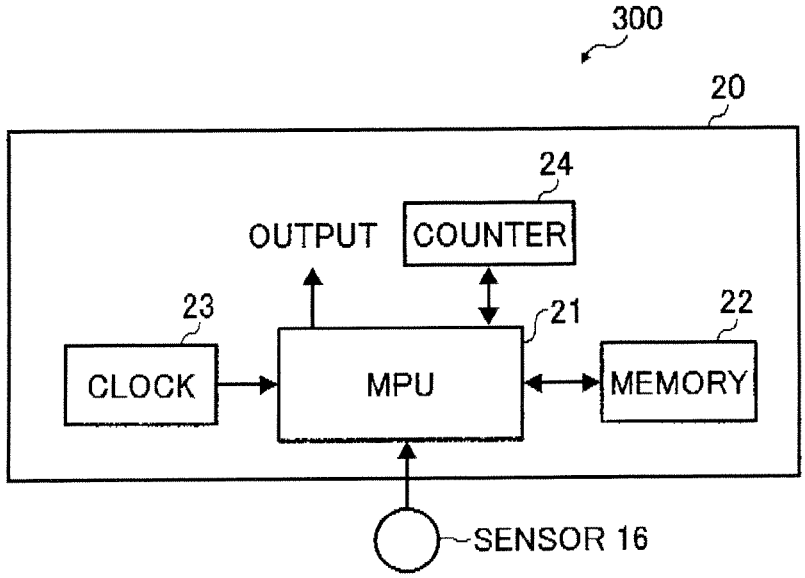
FIG. 6 is a schematic diagram of a control unit of a different image forming apparatus according to another exemplary embodiment of the present invention.

Referring to FIG. 6, a schematic diagram of a control unit 20 of an image forming apparatus 300 according to another embodiment of the present invention is described.

The control unit 20 of FIG. 6 includes a microcomputer (MPU) 21 serving as a main controller, a storing unit or memory 22 that stores control programs and data therein, a clock 23 that measures time, and a determination counter 24 that detects and counts the number of impacts occurred due to the separation of the secondary transfer roller 14 from the intermediate transfer belt 7.

In FIG. 6, the control unit 20 of the image forming apparatus 300 according to the present invention may determine whether or not to regard or account for defect image patterns as input information for adjusting the image forming condition, based on the detection result obtained by the determination counter 24 according to the movement or separation of the secondary transfer roller 14.

In an exemplary embodiment of the present invention, in order to reduce the amount of toner consumed and to reduce the load to the belt cleaning device 12 of the intermediate transfer belt 7, the image forming apparatus 300 employs a mode in which a plurality of image adjustment patterns may not be irradiated or exposed selectively. With this operation, any visible image adjustment pattern may not be formed while the secondary transfer roller 14 separates from the intermediate transfer belt 7. Thereby, wasteful toner consumption and unnecessary load to the belt cleaning device 12 can be reduced or prevented if possible.

Specifically, the determination counter 24 that serves as a determination unit is provided to count and determine whether any mechanical impact or vibration is caused while separating the secondary transfer roller 14 by detecting "impact while separation of the secondary transfer roller 14."

The determination counter 24 counts up or increments by one when both Equations 1 and 2 are satisfied at the same time.

For example, when the determination counter 24 counts up or increments sequentially for five times, the impact or vibration caused due to the movement of the secondary transfer roller 14 may be determined as major impact.

Under such condition, the image adjustment patterns may not be formed at the timings of separations after the last separation of the secondary transfer roller 14.

When the determination counter 24 counts up or increments sequentially for five times or when the determination counter 24 detects "no impact while separation of the secondary transfer roller 14", the number of counts of the determination counter 24 may be reset to zero.

As described above, in an exemplary embodiment of the present invention, when an image adjustment operation is conducted immediately after a printing operation in which the secondary transfer roller 14 was held in contact with the intermediate transfer belt 7, the image forming apparatus 200 or 300 may conduct the image adjustment operation as quickly and effectively as possible so as to get ready for following printing operations.

In addition, the optical sensors 16 are mounted on a wide area at the downstream side of the secondary transfer area in the rotational direction of the intermediate transfer belt 7.

With such configuration, the space between the primary transfer portions of the image forming device that is disposed at the most downstream side thereof (i.e., the image forming device 1BK) and the secondary transfer portion and the distance between the primary transfer portion and the secondary transfer portion can be reduced. Accordingly, the period of time for the printing operation can be reduced.

The image adjustment patterns may include one pattern per color or a plurality of different patterns per color.

An image adjustment pattern of one color may include a same amount of toner as respective image adjustment patterns of the other colors.

These image adjustment patterns having an identical amount of toner to each other may be formed in one line along a main scanning direction on the intermediate transfer belt 7. The optical sensors 16 provided each color (e.g., four optical sensors 16) detects the amounts of toner adhered onto each image adjustment pattern to form images so that the color balance and tone of each obtained image can be optimized according to the amount of detected toner density.

The above-described operation may be generally controlled to perform at intervals of operations for printing a given number of sheets (e.g., some dozens or some hundreds of printouts).

Accordingly, the amount of toner consumed for forming image adjustment patterns can be reduced to a value below a give value.

Next, some main operations for image adjustment are described.

(Toner Supplying Control)

A period of time for supplying toner may be calculated based on the output value obtained when the optical sensor 16 detects the toner density of an image adjustment pattern, the reference value of the toner density control, and image pixel detection data, so as to drive a toner supplying motor (not shown).

(Potential Control)

As shown in FIG. 2, the image forming devices 1Y, 1C, 1M, and 1BK can cause a given charge voltage and a given LD power to form respective given electrostatic latent images (VD: charge potential and VL: potential at LD writing unit) of the image adjustment patterns on the photoconductors 2Y, 2C, 2M, and 2BK.

While changing a development bias voltage Vb in steps, a plurality of patterns (ten patterns from 1 through 10) having different amounts of toner density from each other may be formed on each of the photoconductors 2Y, 2C, 2M, and 2BK. Then, the plurality of patterns may be transferred onto the surface of the intermediate transfer belt 7. The respective optical sensors 16 may detect the plurality of patterns (ten patterns from 1 through 10) having different amounts of toner density from each other. Respective development input and output characteristics may be obtained based on the output values (e.g., Vsp Y, Vsp C, Vsp M, and Vsp BK) detected by the respective optical sensors 16. Accordingly, each development bias Vb may be adjusted so that these characteristics can become the target value.

As described above, at least one exemplary embodiment of the present invention is applicable to a tandem type image forming apparatus in which a plurality of image forming devices may be included therein. However, the present invention is also applicable to a different image forming apparatus in which one image bearing member (i.e., photoconductive drum, photoconductive belt, or so forth) forms an electrostatic latent image developed by a corresponding one of a plurality of developing units.

Such image forming apparatus may further include an intermediate transfer member (i.e., intermediate transfer belt, intermediate transfer drum, or so forth) that receives respective single toner images on a surface thereof.

In the image forming apparatus having one image bearing member, one single toner image may be formed on the image bearing member and developed by a corresponding one of the plurality of developing units. The visible single color toner image may be primarily transferred onto the intermediate transfer member one by one (for four times, in this case) to form an overlaid full color toner image. Then, a secondary transfer member may attract the overlaid full color toner image on the intermediate transfer member to secondarily transfer the toner image onto a transfer medium.

By changing the separation timing of the secondary transfer roller 14, any of the image forming apparatuses 100, 200, and 300 with a method of using a contact secondary transfer member for less ozone production can reduce its entire size or enhance print productivity, resulting in a reduction of the downtime, without the above-described impact or vibration due to the separation of the secondary transfer roller 14 from the intermediate transfer belt 7 with respect to regular images formed on the image forming area and image adjustment patterns formed on the non-image forming area.

Further, when the secondary transfer roller 14 separates the intermediate transfer belt 7 during any of writing the plurality of image adjustment patterns on the plurality of photoconductors 2Y, 2C, 2M, and 2BK in a circumferential direction of the intermediate transfer belt 7, developing the plurality of image adjustment patterns, and transferring the plurality of image adjustment patterns onto the intermediate transfer belt 7, it is determined that at least one of writing, developing, and transferring is not conducted when the secondary transfer roller 14 separates from the intermediate transfer belt 7. Thereby, the consumption of an excess amount of toner may be reduced.

As described above, the present invention can reduce the period of time during the printing operation for image adjustment, making the time as short as possible.

To enable the reduced time period, a secondary transfer member (e.g., the secondary transfer roller 14) may separate from or no longer contact with an intermediate transfer member (e.g., the intermediate transfer belt 7) when image adjustment patterns formed during an image forming process control and/or a toner density control pass the secondary transfer portion.

In such a case, it is determined whether any adverse affect, such as mechanical impact or vibration, is exerted on the image forming process control conducted based on the detection of the image adjustment patterns.

When it is determined that the image forming process control is adversely affected, such affect may be removed.

Further, by accounting for the set location of the optical sensors, the image forming apparatus may include an image correction unit that may enhance image quality, as well as units for reducing the time taken for the image adjustment operation and for enhancing productivity of copies or prints. Thereby, the image forming apparatus can reduce the production amount of ozone or other harmful substances.

Therefore, the present invention can be preferably used for an image forming apparatus such as a copier, printer, plotter, facsimile machine, and other printing machines, which include an intermediate transfer member for color image forming. Further, the present invention can provide such copier, printer, plotter, facsimile machine, and other printing machines, which can control image density, tone, and so forth in an appropriate manner for producing high quality images.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a secondary transfer member disposed so as to be held in contact with the intermediate transfer member for a secondary transfer and configured to transfer the image onto a recording medium during the image forming operation, the secondary transfer member configured to separate from the intermediate transfer member when the plurality of image adjustment patterns are transferred onto the intermediate transfer member during the image adjustment operation; and at least one optical sensor configured to detect respective amounts of toner adhered to the plurality of image adjustment patterns so that the image forming apparatus conducts image forming process control by controlling toner density of each of the plurality of image adjustment patterns based on detected amounts of toner, wherein when output values of the respective amounts of toner fall outside a given range and an interval between the output values of adjacent image bearing members of the at least one image bearing member is substantially equal to a distance between the two adjacent image bearing members for the primary transfer, it is determined that the output values of the respective amounts of toner detected by the at least one optical sensor are affected by an impact caused due to a separation of the secondary transfer member from the intermediate transfer member and the output values of the respective amounts of toner are ignored as image adjustment input information.

2. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a secondary transfer member disposed so as to be held in contact with the intermediate transfer member for a secondary transfer and configured to transfer the image onto a recording medium during the image forming operation, the secondary transfer member configured to separate from the intermediate transfer member when the plurality of image adjustment patterns are transferred onto the intermediate transfer member during the image adjustment operation; and at least one optical sensor configured to detect respective amounts of toner adhered to the plurality of image adjustment patterns so that the image forming apparatus conducts image forming process control by controlling toner density of each of the plurality of image adjustment patterns based on detected amounts of toner, wherein output values of the respective amounts of toner are ignored as image adjustment input information when the secondary transfer member separates from the intermediate transfer member.

3. The image forming apparatus recited in claim 2, wherein the at least one optical sensor is disposed at a downstream side of a transfer portion in a travel direction of the intermediate transfer member and faces downward with respect to a horizontal surface of the intermediate transfer member.

4. The image forming apparatus recited in claim 2, wherein the at least one optical sensor is a light reflection type photosensor including a light-emitting element and a light receiving element.

5. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a secondary transfer member disposed so as to be held in contact with the intermediate transfer member for a secondary transfer and configured to transfer the image onto a recording medium during the image forming operation, the secondary transfer member configured to separate from the intermediate transfer member when the plurality of image adjustment patterns are transferred onto the intermediate transfer member during the image adjustment operation; and at least one optical sensor configured to detect respective amounts of toner adhered to the plurality of image adjustment patterns so that the image forming apparatus conducts image forming process control by controlling toner density of each of the plurality of image adjustment patterns based on detected amounts of toner, wherein output values of the respective amounts of toner are ignored as image adjustment input information when the plurality of image adjustment patterns are transferred onto the intermediate transfer member.

6. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a secondary transfer member disposed so as to be held in contact with the intermediate transfer member for a secondary transfer and configured to transfer the image onto a recording medium during the image forming operation, the secondary transfer member configured to separate from the intermediate transfer member when the plurality of image adjustment patterns are transferred onto the intermediate transfer member during the image adjustment operation;

a determination unit configured to determine whether an impact is caused due to a separation of the secondary transfer member from the intermediate transfer member; and at least one optical sensor disposed at a downstream side of a transfer portion in a travel direction of the intermediate transfer member, the at least one optical sensor configured to detect respective amounts of toner adhered to the plurality of image adjustment patterns so that the image forming apparatus conducts image forming process control by controlling toner density of each of the plurality of image adjustment patterns based on the detected amounts of toner, wherein the image forming apparatus is controlled to refrain from forming the plurality of image adjustment patterns created based on output values obtained by the at least one optical sensor when the secondary transfer member separates from the intermediate transfer member when the determination unit determines that a frequency of the impact is outside of a given range.

7. The image forming apparatus recited in claim 6, wherein the at least one optical sensor is a light reflection type photosensor including a light-emitting element and a light receiving element.

8. The image forming apparatus recited in claim 6, wherein the at least one optical sensor is disposed at a downstream side of a transfer portion in a travel direction of the intermediate transfer member and faces downward with respect to a horizontal surface of the intermediate transfer member.

9. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a secondary transfer member disposed so as to be held in contact with the intermediate transfer member for a secondary transfer and configured to transfer the image onto a recording medium during the image forming operation, the secondary transfer member configured to separate from the intermediate transfer member when the plurality of image adjustment patterns are transferred onto the intermediate transfer member during the image adjustment operation;

a determination unit configured to determine whether an impact is caused due to a separation of the secondary transfer member from the intermediate transfer member; and at least one optical sensor disposed at a downstream side of a transfer portion in a travel direction of the intermediate transfer member, the at least one optical sensor configured to detect respective amounts of toner adhered to the plurality of image adjustment patterns so that the image forming apparatus conducts image forming process control by controlling toner density of each of the plurality of image adjustment patterns based on the detected amounts of toner, wherein output values of the respective amounts of toner are ignored as image adjustment input information when the plurality of image adjustment patterns are transferred onto the intermediate transfer member.

10. An image forming apparatus, comprising:

at least one image bearing member configured to bear an image in an image forming area for an image forming operation and a plurality of image adjustment patterns in a non-image forming area for an image adjustment operation;

an intermediate transfer member disposed so as to be held in contact with the at least one image bearing member for a primary transfer and configured to receive a plurality of image adjustment patterns formed on the at least one image bearing member;

a detection unit configured to detect a change in a rotational transfer velocity of the intermediate transfer member;

a secondary transfer member disposed so as to be held in contact with the intermediate transfer member for a secondary transfer and configured to transfer the image onto a recording medium during the image forming operation. the secondary transfer member configured to separate from the intermediate transfer member when the plurality of image adjustment patterns are transferred onto the intermediate transfer member during the image adjustment operation; and at least one optical sensor disposed at a downstream side of a transfer portion in a travel direction of the intermediate transfer member, the at least one optical sensor configured to detect respective amounts of toner adhered to the plurality of image adjustment patterns so that the image forming apparatus conducts image forming process control by controlling toner density of each of the plurality of image adjustment patterns based on the detected amounts of toner, wherein output values obtained by the at least one optical sensor are ignored as image adjustment input information for image condition adjustment when the detection unit detects that the rotational transfer velocity of the intermediate transfer member falls outside of a given range.

11. The image forming apparatus recited in claim 10, wherein output values obtained by the at least one optical sensor are image adjustment input information for image condition adjustment when the detection unit detects that the rotational transfer velocity of the intermediate transfer member falls inside of a given range.

12. The image forming apparatus recited in claim 10, wherein the at least one optical sensor is disposed at a downstream side of a transfer portion in a travel direction of the intermediate transfer member and faces downward with respect to a horizontal surface of the intermediate transfer member.

* * * * *